US007059913B1

(12) United States Patent
Chen

(10) Patent No.: US 7,059,913 B1
(45) Date of Patent: Jun. 13, 2006

(54) EXPRESS CARD ADAPTER CARD

(75) Inventor: George Chen, Taipei (TW)

(73) Assignee: D & C Technology Co., Ltd., Hsien Tien (TW)

( * ) Notice: Subject to any disclaimer, the term of this patent is extended or adjusted under 35 U.S.C. 154(b) by 0 days.

(21) Appl. No.: 11/076,973

(22) Filed: May 31, 2005

(51) Int. Cl.
*H01R 12/00* (2006.01)

(52) U.S. Cl. ..... 439/638; 439/76.1; 439/945

(58) Field of Classification Search ..... 439/945, 439/946, 76.1, 638, 630; 361/737, 752, 818
See application file for complete search history.

(56) References Cited

U.S. PATENT DOCUMENTS 6,132,223 A * 10/2000 Seeley et al. ..... 439/76.1
6,381,144 B1 * 4/2002 Chiang ..... 361/737
6,547,603 B1 * 4/2003 Yu ..... 439/638
6,902,435 B1 * 6/2005 Cheng ..... 439/630
6,932,623 B1 * 8/2005 Lai ..... 439/76.1

* cited by examiner

*Primary Examiner*—Gary Paumen

(57) ABSTRACT

An Express Card adapter card structured from a plastic frame, a connector and two metal covers, and characterized, in that front and rear ends of the plastic frame are provided with an Express Card insertion opening and a placement area for installing a connector respectively. Two side outer edges of each of the metal covers are respectively provided with inwardly bent hook strips, which enable hooking within the corresponding grooves. Internal edges of each of the metal covers are provided with a plurality of catch hooks, a grounding elastic strip and a hook portion. According to the aforementioned structure, it is not only convenient and economical to manufacture, moreover, after rigid fixing, the firm structure assures the Express Card adapter card will not easily come apart.

5 Claims, 4 Drawing Sheets

EXPRESS CARD ADAPTER CARD

BACKGROUND OF THE INVENTION (a) Field of the Invention

The present invention relates to an Express Card adapter card, and more particularly to an adapter card that transforms an Express Card into a PCMCIA interface. The adapter card is not only convenient and economical to manufacture, moreover, after rigid fixing, the firm structure assures the Express Card adapter card will not easily come apart.

(b) Description of the Prior Art

PC Card (also called PCMCIA card) specifications as drawn up by the PCI-SIG (PCI Special Interest Group) have a long history, and early in 1990, ISA was used for internal transmission channels. However, theoretical bandwidth of the PC Card was only 16 MB/s. In 1995, PCI standards were formulated for the transmission channels used in the 32-bit Card Bus specifications, and are still being followed to this day. However, existing PC Card specifications are unable to satisfy modern requirements for bandwidth and size, in particular, notebook computers, which have a greater demand for new PC Card specifications. Hence, PC Express was announced as the official name of the next generation bus structure by PCMCIA on Apr. 17, 2002, and simultaneously publicized the Express Card specifications that would replace the PC Card. A major distinguishing feature of the Express Card is its high integration of PCI Express and USB 2.0, which differentiates it from the Card Bus based on PCI. If USB 2.0 is used as the transmission channel, then theoretical bandwidth attainable is 480 Mb/s (60 MB/s). However, when changed to PCI Express 1×, then the transmission bandwidth of the Express Card reaches 500 MB/s, far exceeding that attainable by existing PCI bus specifications. Furthermore, the Express Card meets market demands because of its smaller size compared to that of the PC Card. Hence, the inventor of the present invention has specifically designed an adapter card that provides for the insertion of the new Express Card, whereupon the adapter card transfers data stored within the Express Card for direct use by existing computer equipment, thereby eliminating the need to update the computer equipment to accommodate establishment of the Express Card specifications. Moreover, the present invention is not only practical and convenient, but also easy and economical to manufacture.

SUMMARY OF THE INVENTION

In light of the aforementioned diversity in different specifications, the inventor of the present invention, having accumulated years of experience in related arts, attentively and circumspectly carried out extensive study and exploration to ultimately design a completely new structure for an Express Card adapter card.

A primary objective of the present invention is to provide an adapter card that transforms an Express Card into a PC Card, and, furthermore, provide the adapter card that is not only convenient and economical to manufacture, moreover, after rigid fixing, the firm structure assures the Express Card adapter card will not easily come apart.

In order to achieve the aforementioned objective, the Express Card adapter card of the present invention is structured to comprise a plastic frame, a connector and two metal covers, wherein the plastic frame has a slight U-shape, front and rear ends of which are provided with an Express Card insertion opening and a placement area for installing the connector respectively. Moreover, grooves are defined on outer edge portions of left and right sides of the plastic frame. A plurality of clasp holes are defined at appropriate positions on two sides above and below an Express Card slot of the plastic frame, and two insertion holes are defined facing each other on two sides of the Express Card slot. Each of the insertion holes embodies a grounding strip positioning hole and a clasp. The connector includes a circuit board, two ends of which are respectively configured with a PC Card interface and an Express Card connector. The connector is disposed in positioning portions of the placement area of the plastic frame. In addition, two side outer edges of each of the metal covers are respectively provided with inwardly bent hook strips, which enable hooking within the corresponding grooves. Internal edges of each of the metal covers are provided with a plurality of catch hooks, a grounding elastic strip for inserting within a corresponding grounding strip positioning hole and a hook portion for hooking within the corresponding clasps. Moreover, each of the catch hooks is provided with a side hook portion.

According to the aforementioned structural members, the steps to assemble the adapter card of the present invention are described below:

1. Insert one of the metal covers into the plastic frame from above, and hook the hook strips of the metal cover into the corresponding grooves of the plastic frame, whereupon the catch hooks insert and secure within the corresponding clasp holes. The grounding elastic strip and the hook portion respectively connect into insertion holes on two sides of the plastic frame.

2. Position the connector and dispose within the placement area of the plastic frame.

3. Repeat step 1 to dispose the other metal cover into the plastic frame from below, thereby completing assembly of the adapter card, with the connector firmly clasped between the plastic frame and the metal covers. Thus, realizing a substantially convenient assembly.

Because shape of the two metal covers is identical, thus, there is no need to design extra molds, and achieves the objective of being convenient and economical to manufacture. In addition, after completing assembly of the adapter card, the hook strips on outer edges of the metal covers are hooked within the grooves of the plastic frame. Furthermore, the hook portions on two sides of catch hooks of the metal covers are tightly secured within the catch holes, thereby enabling the metal covers and the plastic frame to realize a completely compact and rigid form having a firm structure that will not easily come apart.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
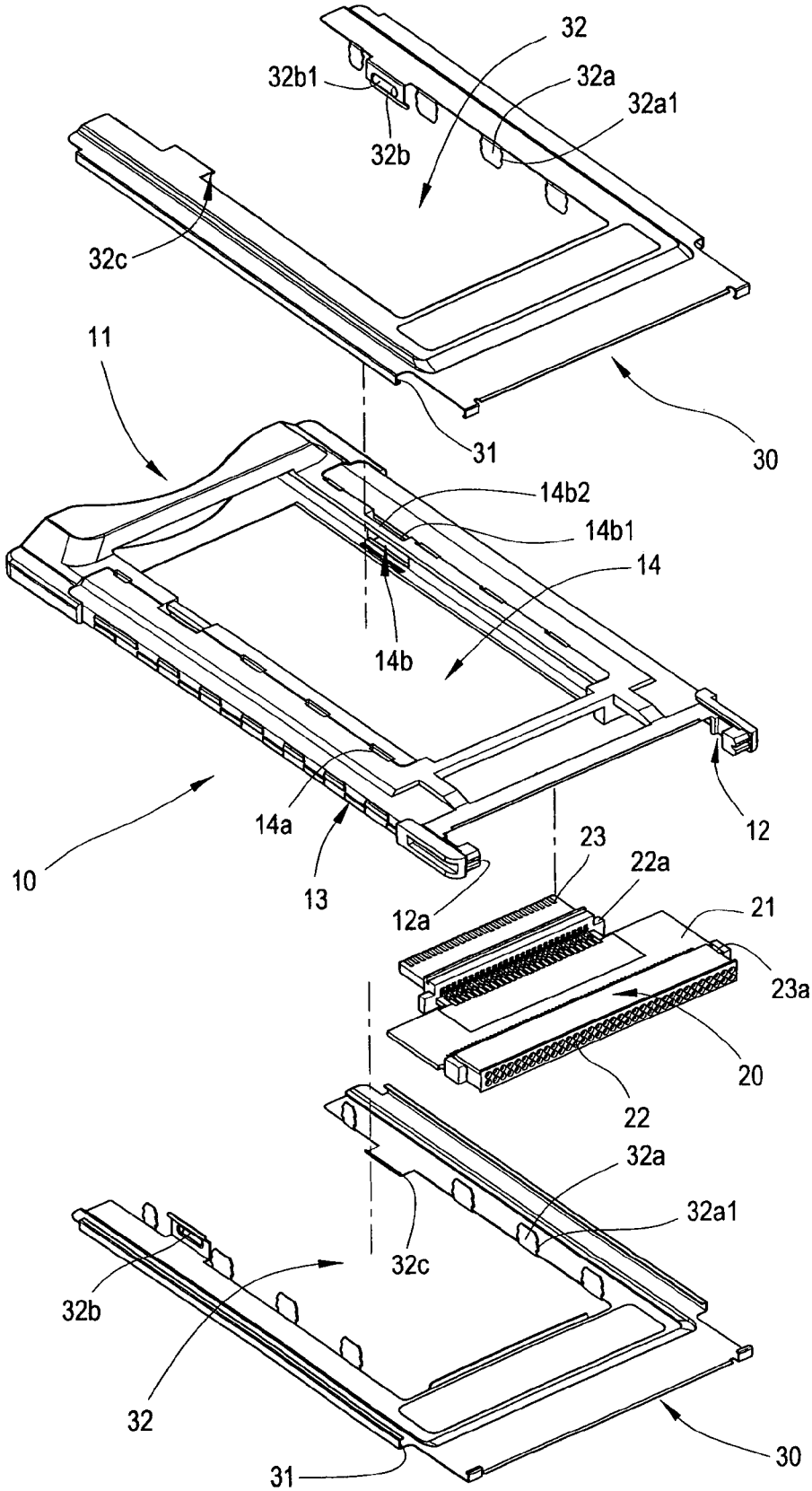
FIG. 1 shows an exploded elevational view according to the present invention.
Figure 2:
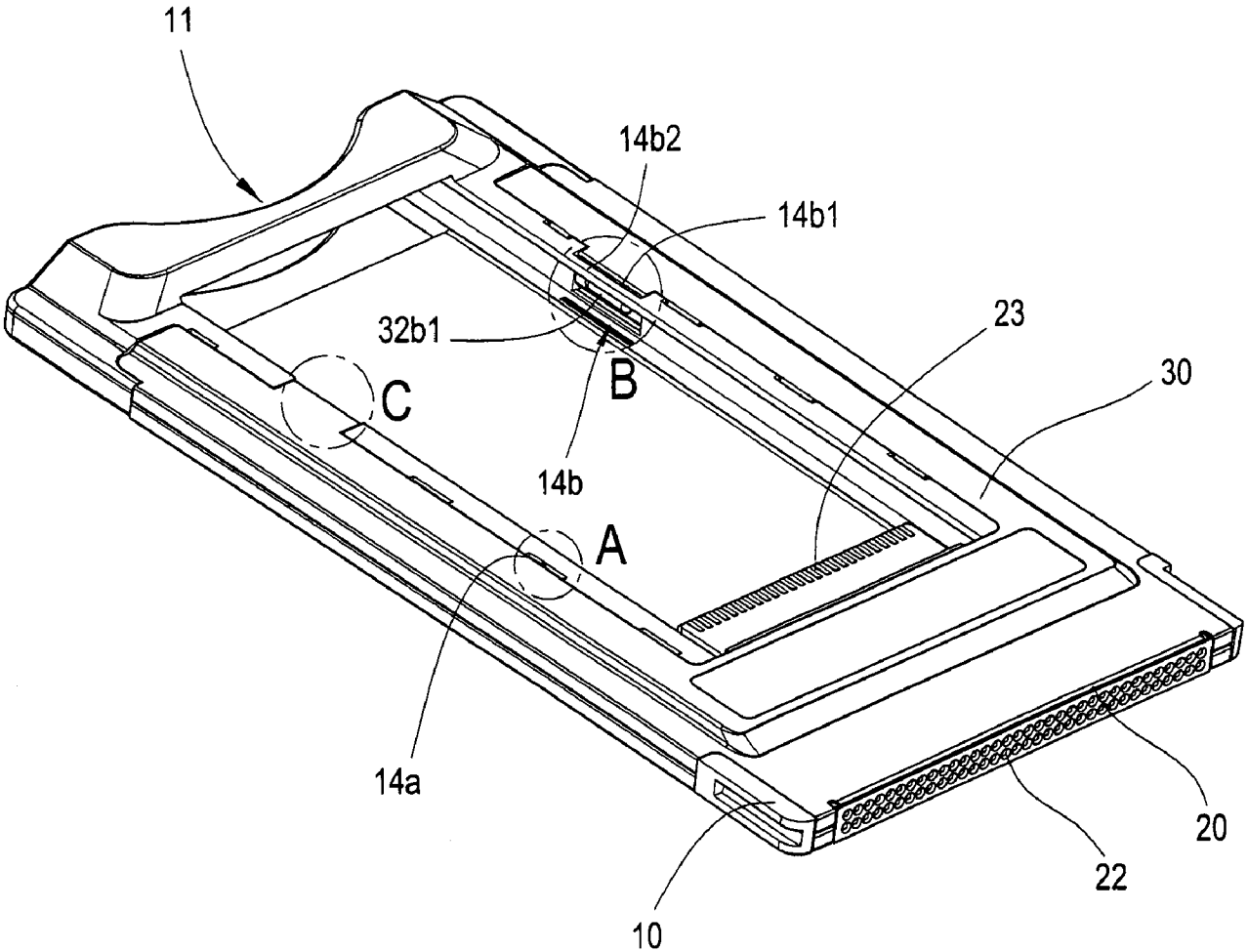
FIG. 2 shows an assembled elevational view according to the present invention.
Figure 2C:
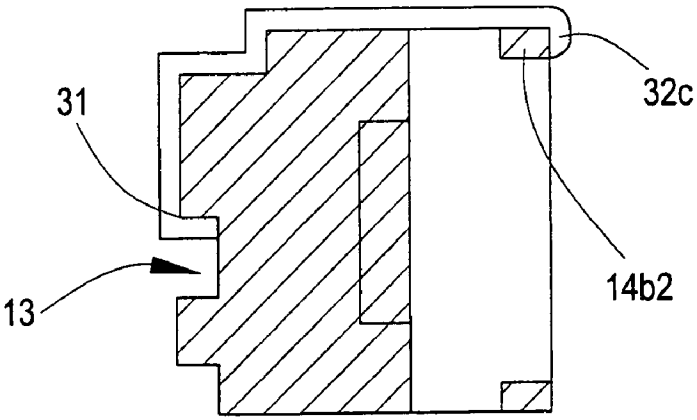
FIG. 2C shows an enlarged partial view according to the present invention (3).
Figure 2B:
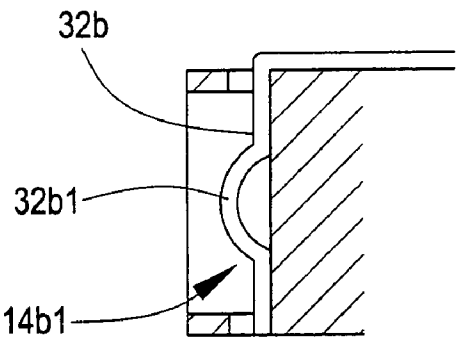
FIG. 2B shows an enlarged partial view according to the present invention (2).
Figure 2A:
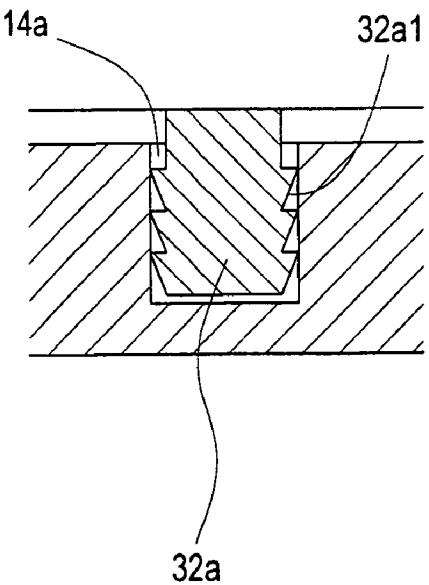
FIG. 2A shows an enlarged partial view according to the present invention (1).

Referring to FIGS. 1, 2, 2A, 2B and 2C, the Express Card adapter card of the present invention is structured to comprise a plastic frame 10, a connector 20 and two metal covers 30, wherein:

the plastic frame 10 has a slight U-shape, front and rear ends of which are provided with an Express Card insertion opening 11 and a placement area 12 for installing the connector 20 respectively. The placement area 12 is further provided with two steel strip positioning portions 12*a*. Moreover, grooves 13 are defined on outer edge portions of left and right sides of the plastic frame 10. A plurality of clasp holes 14*a* are defined at appropriate positions on two sides above and below an Express Card slot 14 of the plastic frame 10, and two insertion holes 14*b* are defined facing each other on two sides of the Express Card slot 14. Furthermore, the clasp holes 14*a* of the two sides are arranged in a staggered fashion to form two parallel straight lines, and each of the insertion holes 14*b* embodies a grounding strip positioning hole 14*b*1 and a clasp 14*b*2;

the connector 20 includes a circuit board 21, two ends of which are respectively configured with a PC Card interface 22 and an Express Card connector 23, Moreover, two sides of the PC Card interface 22 and two sides of the Express Card connector 23 are provided with positioning protruding pieces 22*a*, 23*a* respectively. The positioning protruding pieces 22*a*, 23*a* correspond to the steel strip positioning portions 12*a* of the placement area 12 of the plastic frame 10;

the metal covers 30, two side outer edges of which are respectively provided with inwardly bent hook strips 31, which enable hooking within the corresponding grooves 13. A plurality of bent catch hooks 32*a* are configured on edge portions of an internal hole 32 of the metal covers 30. Each of the catch hooks 32*a* is provided with a side hook portion 32*a*1. Moreover, one side of each of the metal covers 30 is provided with a grounding elastic strip 32*b*, on which is provided a grounding conduction point 32*b*1, and another side opposite to the grounding elastic strip 32*b* is provided with a hook portion 32*c*.

Hereinafter are the steps to assemble the adapter card of the present invention: 1. Insert one of the metal covers 30 into the plastic frame 10 from above, and hook the hook strips 31 of the metal cover 30 into the corresponding grooves 13 of the plastic frame 10, whereupon the catch hooks 32*a* insert and secure within the corresponding clasp holes 14*a*, and the grounding elastic strip 32*b* inserts within the corresponding grounding strip positioning hole 14*b*1. The hook portion 32*c* hooks within the corresponding clasp 14*b*2 of another side of the plastic frame 10. 2. Position the connector 20 and dispose within the placement area 12 of the plastic frame 10. 3. Repeat step 1 to dispose the other metal cover 30 into the plastic frame 10 from below, thereby competing assembly of the adapter card, with the connector 20 firmly clasped between the plastic frame 10 and the metal covers 30.

Figure 3:
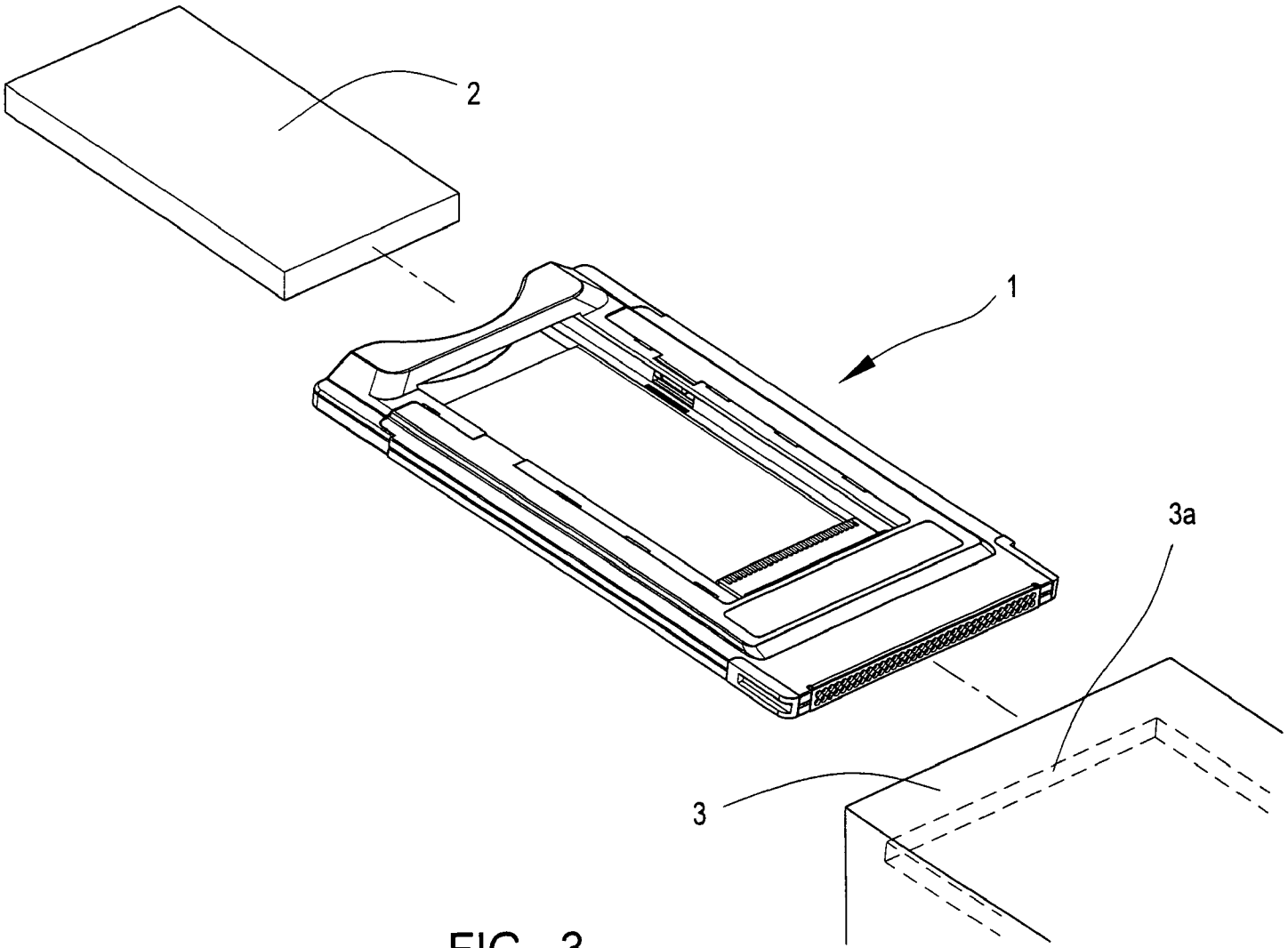
FIG. 3 shows an elevational view of the present invention in use.

Referring to FIG. 3, which shows a schematic view of the present invention in use, wherein an Express Card is directly inserted into an adapter card 1 of the present invention, which is then inserted into a computer PC Card slot 3*a* of a computer facility 3, thereby enabling data stored within the Express Card 2 to be transferred by the adapter card 1 for direct use by the existing computer facility 3.

In conclusion, the Express Card adapter card of the present invention is structured to comprise a plastic frame 10, two metal covers 30 and a connector 20. The present invention is not only convenient and economical to manufacture, moreover, after rigid fixing, the firm structure achieves effectiveness of ensuring the Express Card adapter card will not easily come apart. Advancement and practicability of the present invention clearly comply with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An Express Card adapter card comprising a plastic frame, a connector and two metal covers, wherein:

the plastic frame has a slight U-shape, front and rear ends of which are provided with an Express Card insertion opening and a placement area for installing the connector respectively, the placement area is further provided with a plurality of steel strip positioning portions, moreover, grooves are defined on outer edge portions of left and right sides of the plastic frame, a plurality of clasp holes are defined at appropriate positions on two sides above and below an Express Card slot of the plastic frame, and two insertion holes are defined facing each other on two sides of the Express Card slot;

the connector includes a circuit board, two ends of which are respectively configured with a PC Card interface and an Express Card connector, moreover, two sides of the PC Card interface and two sides of the Express Card connector are provided with positioning protruding pieces respectively;

the metal covers, two side outer edges of which are respectively provided with inwardly bent hook strips, which enable hooking within the corresponding grooves, a plurality of bent catch hooks are configured on edge portions of an internal hole of the metal covers, moreover, one side of each of the metal covers is provided with a grounding elastic strip, and another side opposite to the grounding elastic strip is provided with a hook portion.

2. The Express Card adapter card as described in claim 1, wherein the clasp holes of the two sides are arranged in a staggered fashion to form two parallel straight lines.

3. The Express Card adapter card as described in claim 1, wherein the insertion hole comprises a grounding strip positioning hole and a clasp.

4. The Express Card adapter card as described in claim 1, wherein the catch hook is provided with a side hook portion.

5. The Express Card adapter card as described in claim 1, wherein a grounding conduction point is provided on a grounding elastic strip.

* * * * *